US007748300B2

(12) United States Patent
Picaza Ibarrondo

(10) Patent No.: US 7,748,300 B2
(45) Date of Patent: Jul. 6, 2010

(54) PLIERS

(75) Inventor: Jose Ignacio Picaza Ibarrondo, Abadiano (ES)

(73) Assignee: Rothenberger, S.A., Abadiano, Vizcaya (ES)

( * ) Notice: Subject to any disclaimer, the term of this patent is extended or adjusted under 35 U.S.C. 154(b) by 98 days.

(21) Appl. No.: 12/066,531

(22) PCT Filed: Apr. 7, 2006

(86) PCT No.: PCT/ES2006/000166

§ 371 (c)(1),
(2), (4) Date: Mar. 12, 2008

(87) PCT Pub. No.: WO2007/116104

PCT Pub. Date: Oct. 18, 2007

(65) Prior Publication Data

US 2008/0264217 A1 Oct. 30, 2008

(51) Int. Cl.
*B25B 7/04* (2006.01)

(52) U.S. Cl. ..... 81/409.5; 81/391

(58) Field of Classification Search ..... 81/405–416, 81/177.9, 391–394

See application file for complete search history.

(56) References Cited

U.S. PATENT DOCUMENTS

| | | | | |
|---|---|---|---|---|
| 6,530,099 | B1 * | 3/2003 | Iwinski | 7/133 |
| 6,941,663 | B2 * | 9/2005 | Still | 30/250 |
| 2003/0140742 | A1 * | 7/2003 | Nouvel | 81/409 |

FOREIGN PATENT DOCUMENTS

| | | |
|---|---|---|
| DE | 3303369 Y | 8/1984 |
| DE | 19924664 XY | 11/2000 |
| ES | 2 277 520 B1 | 5/2008 |

* cited by examiner

*Primary Examiner*—D. S Meislin
(74) *Attorney, Agent, or Firm*—Lucas & Mercanti, LLP

(57) ABSTRACT

Pliers, with two arms that are joined together via an articulation pin. One of the arms has a protuberance with a lateral channel that extends via one of the orifices, a pusher being located in the channel and having an inner channel that accommodates a spring that acts between the pusher and the arm. The articulation pin is joined by means of screwing to the pusher in the region of the lateral channel, a toothed claw being arranged coaxially therebetween with mechanical continuity. The pusher is continued as an extension located on the walls of the other orifice in the work position. Applicable to hand tools.

3 Claims, 3 Drawing Sheets

PLIERS

BACKGROUND OF THE INVENTION

The subject of the invention refers to pliers of the type used in plumbing, for example.

This type of pliers is already known in the current state of the technique. Adjustable pliers are even known, comprised of two arms that are joined together by an articulating bolt and where one of the arms can be progressively adjusted in an almond-shaped window of the other arm to vary the size of the jaws of the pliers.

Based on this need to vary the size of the jaws of the pliers, some pliers have been developed with a very reliable, solid and easy-to-handle mechanism, that permits going quickly from a work position (where the jaws of the pliers maintain their constant separation whilst the arms/jaws mutually rotate to open/close) to an adjustment position (where one arm moves in a linear direction with respect to the other in the almond-shaped window). The Spanish patent P20501312, of the same applicant refers to this type of pliers, for example.

SUMMARY OF THE INVENTION

The pliers targeted by the invention offer a more simplified construction, eliminating the bushing that, in Patent 200501312, is inserted between the pawl and the pusher which is now a single-block piece that carries out the function of pusher and bushing.

The advantages of eliminating the bushing and inserting this single-block part (pusher+bushing) are as follows:

a) the total number of pliers parts is reduced b) it permits better alignment of the locking system as fewer components intervene c) it requires less machining demands, on not having to align so many components d) smoother operation e) less risk of it seizing up, and f) easier to assemble on not having to position the bushing in its housing or having to hold it.

BRIEF DESCRIPTION OF THE DRAWINGS

In order to understand the subject of this invention better, a preferential form of practical execution is illustrated on the drawings, subject to incidental changes that take nothing away from its foundation.

DETAILED DESCRIPTION OF THE INVENTION

Figure 1:
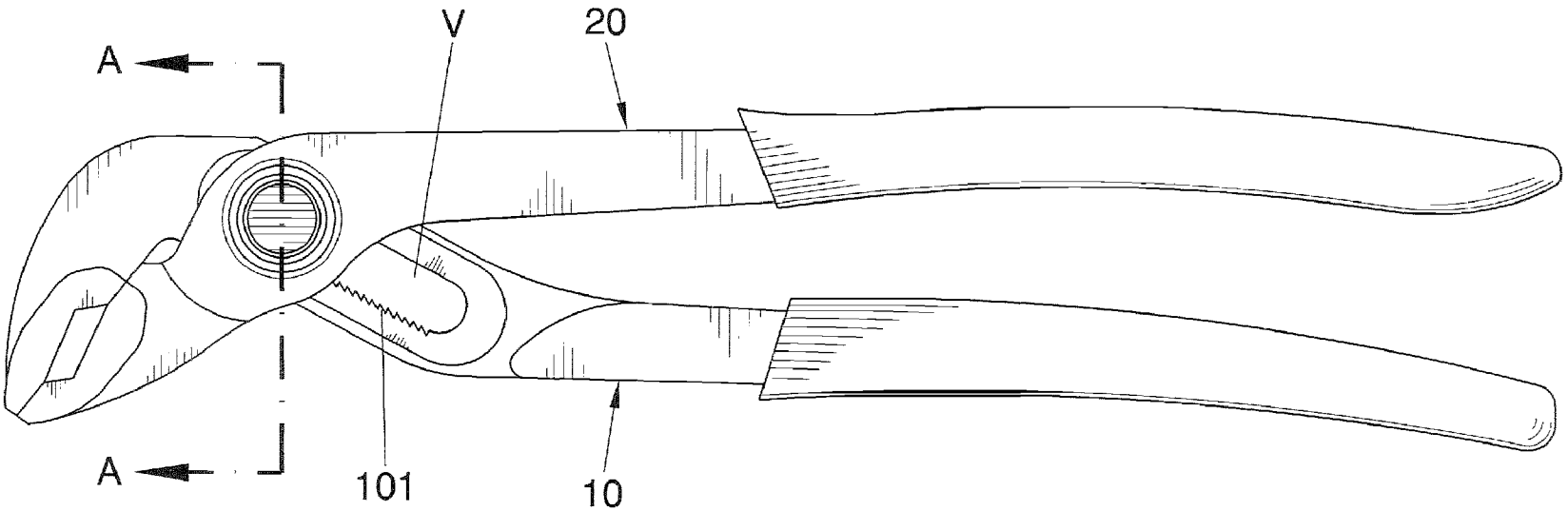
FIG. 1 shows a general elevation view of some pliers according to the invention for a—non-limiting—example of practical execution.

An example of a non-limiting practical execution of this invention is described below.

The subject of this invention refers to pliers of the type made up of two arms, one male (10) and another female (20), which bear the respective jaw clamps. These arms (10) and (20) are joined together by a hinge pin (2), which, forming the spin axis of the female arm (20), has multiple and progressive positions in an almond-shaped window (V) of the male arm (10) to vary the size of the jaw of the pliers.

As it is commonly known, the female arm (20) defines some coaxial openings, a first one ($O_1$) and a second one ($O_2$) where the hinge pin (2) is mounted, which has a toothed pawl (1) which may or may not engage with a toothing (101) defined in the almond-shaped window (V) of the male arm (10).

Figure 2:
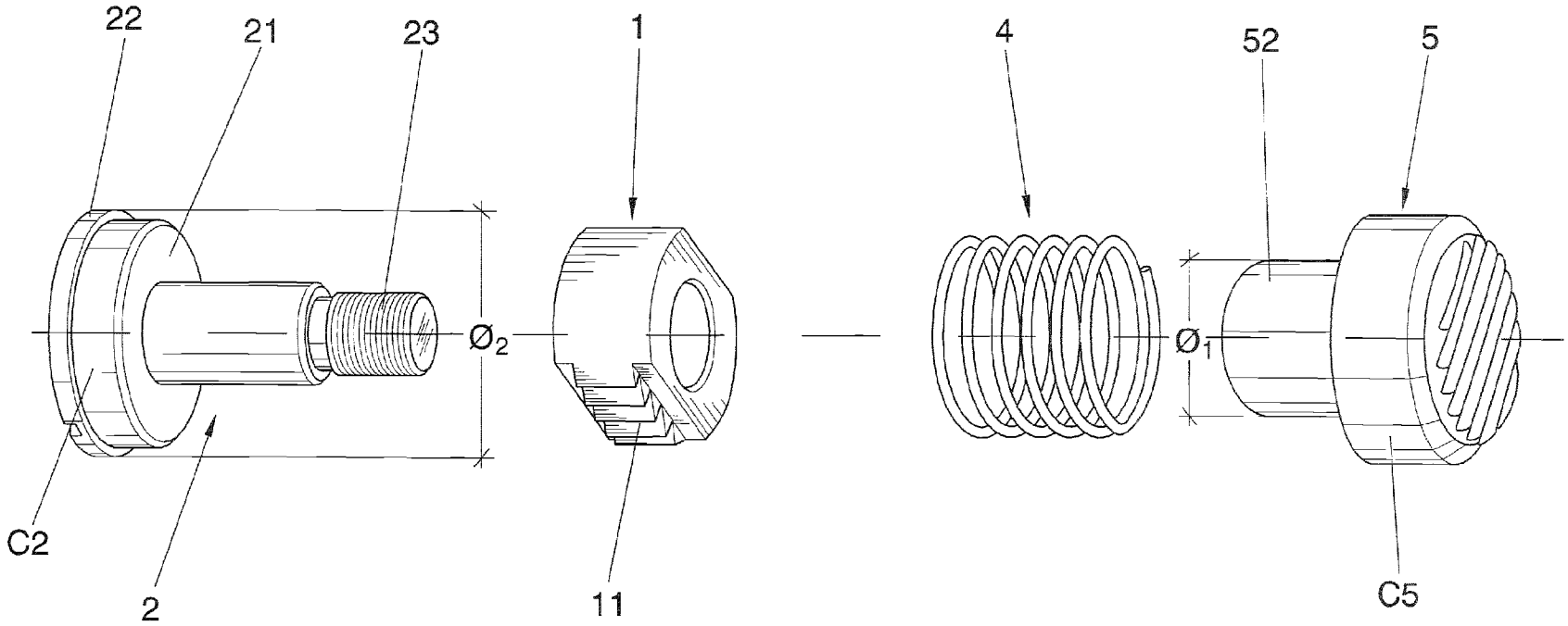
FIG. 2 shows a general perspective view of the adjustment shaft (2) with the remaining components—toothed pawl (1), spring (4) and pusher (5)—ready to mount.
Figure 3:
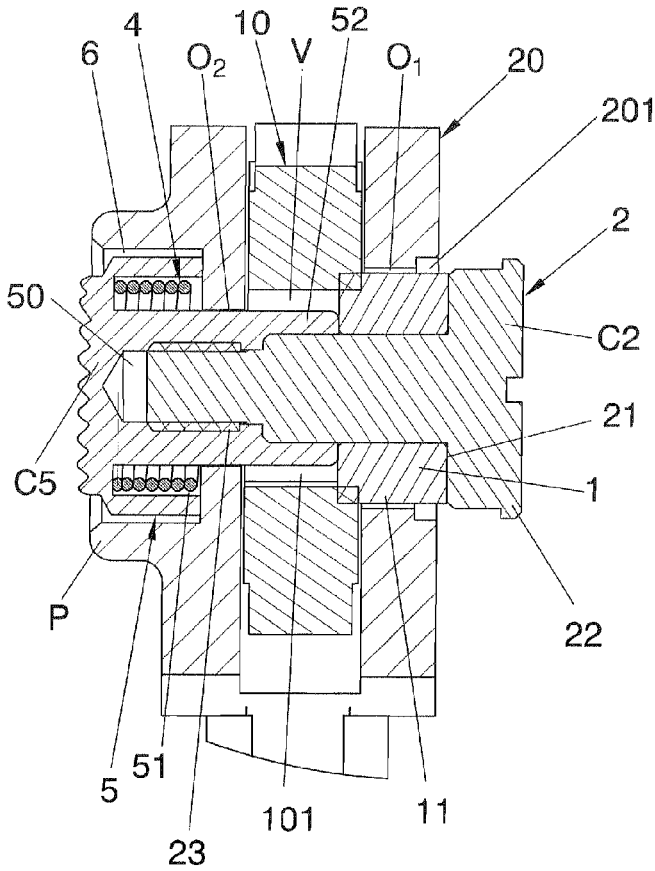
FIG. 3 shows a general amplified section, according to indication A:A of FIG. 1, to execute FIG. 2, in adjustment position.
Figure 4:
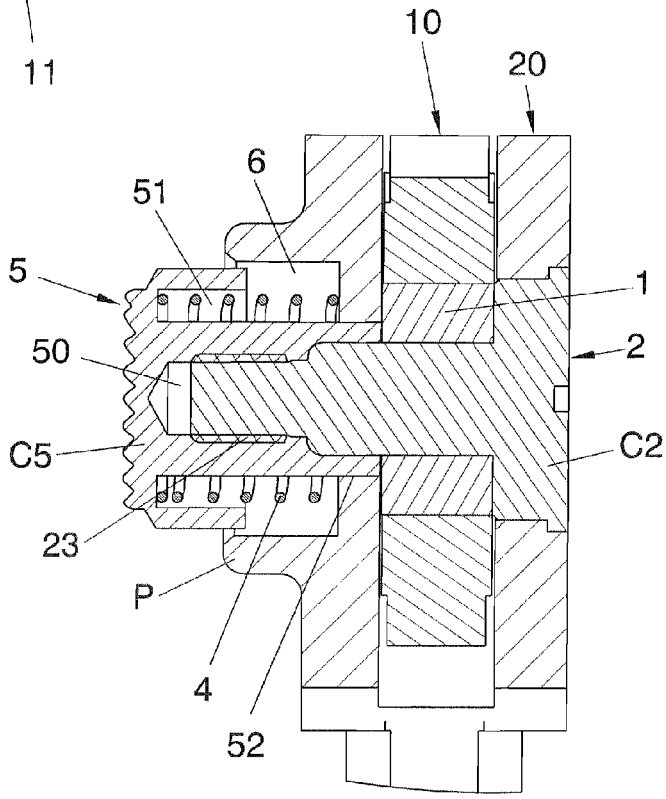
FIG. 4 shows a general amplified section, according to indication A:A of FIG. 1, to execute FIG. 2 in work position.

In agreement with the invention, and according to the execution shown in FIGS. 2 to 4:

The female arm (20) bears a side protuberance (P) on which a side box-shaped opening (6) has been executed, coaxial with the two openings ($O_1$), ($O_2$) of the female arm (20).

On one end, the hinge pin (2) defines a headpiece ($C_2$), with a surrounding ledge (22) and an internal seat (21) and, on the other end, a threaded area (23). The ledge (22), seat (21) and the threaded area (23) preferably have a successively smaller diameter: The ledge (22) with a greater diameter than the seat (21); both with greater diameter than the central area of the pin (2) and all of them with a greater diameter than the end threaded area (23)—although this geometry is not limiting and if altered, the essence of the invention does not change.

A toothed pawl (1) is placed in the central area of the pin (2) limited at the side by the seat (21). This toothed pawl (1) forms some outer teeth (11), which may or may not engage in some conjugated teeth (101) foreseen in the almond-shaped window (V) of the male arm (10).

There is a threaded pusher (5) in the end area (23) of the pin (2). This pusher (5) coaxially defines an inner box-shaped opening (51) and an extension (52) with an opening (50) on the inside which goes beyond its headpiece ($C_5$), where this inner box-shaped opening (51) is formed—see FIGS. 3 and 4.

The internal opening (50), threaded at its base, permits the pin (2) to be screwed in (23), leaving the extension (52) of the pusher (5) unscrewed, accompanying the central area of the pin (2) and being limited at the side by the aforementioned toothed pawl (1), in mechanical continuity.

In particular, the toothed pawl (1) and, at least, the extension (52) of the pusher (5) are made of wear-resistant material.

There is an internal spring (4) that acts between the pusher (5) and the female arm (20): housed coaxially in these box-shaped openings (6), (51) and acting against its bases, whose aim is to separate the pusher (5) from the female arm (20) and, consequently, to maintain the pin (2) in an extreme position where the toothed pawl (1) maintains its teeth (11) engaged in the conjugated teeth (101) foreseen in the almond-shaped window (V) of the male arm (10).

Openings ($O_1$), ($O_2$) of the female arm (2) have different diameters and, respectively, conjugated from the pin (2) in its seating area (21) and of the extension (52) of the pusher (5). In particular, the diameter of the first opening ($O_1$) is greater than the diameter of the second opening ($O_2$).

With this structure and assembly, a simple manual pressure on the pusher (5) compresses the spring (4) and moves the pin (2) together with the toothed pawl (1) mounted on it, until the teeth (11) of the toothed pawl (1) are released from the teeth (101) of the male arm (10). As long as pressure is maintained on the pusher (5), its extension (52) remains opposite the teeth (101) and this extension (52) can move freely in the window (V) together with the pin (2) and female arm (20) to vary the size of the jaws of the pliers.

The invention can be defined as follows, with reference to the reference characters in the drawings:

Pliers, with two arms, a male arm (10) and a female arm (20) which are joined together by a hinge pin (2); and where the female arm (2) can be progressively adjusted in an almond-shaped window (V) of the male arm (10) to vary the size of the jaws of the pliers; a first coaxial opening ($O_1$) is defined in the female arm (20) as well as a second coaxial opening ($O_2$) where the hinge pin (2) is mounted, which has a toothed pawl (1) which, depending on whether it is in the work position or adjustment position, may or may not engage with toothing (101) defined in the almond-shaped window (V) of the male arm (10); characterised because:

a) The female arm (20) comprises a protuberance (P) where a side box-shaped opening (6) has been executed which extends along the second opening ($O_2$); this box-shaped opening (6) houses a pusher (5) which has an inner box-shaped opening (51) where a spring (4) is located, which acts between the pusher (5) and the female arm (20).

b) The hinge pin (2) is screwed to the pusher (5) in the area of the side box-shaped opening (6), with a toothed pawl (1) being placed coaxially between them and with mechanical continuity.

c) The pusher (5) has push means (52) in mechanical continuity with the toothed pawl (1) and pin (2), which is located on the walls of the second opening ($O_2$) in the work position.

The aforementioned push means is an extension (52) which extends beyond the pusher (5).

The diameter $Ø_1$ of the first opening ($O_1$) is greater than the diameter $Ø_2$ of the second opening ($O_2$): $Ø_1 > Ø_2$.

The first opening ($O_1$) defines a seating (201) on which, in work position, a conjugated ledge (22) of pin (2) rests; so that the head ($C_2$) of the pin (2) does not stand out with respect to the side of the female arm (20).

The toothed pawl (1) and, at least, the extension (52) of the pusher (5) are made of wear-resistant material.

The invention claimed is:

1. Pliers, comprising:

two arms, a male arm and a female arm, each having a handle and an inwardly facing jaw, the inwardly facing jaw of the male arm opposing the inwardly facing jaw of the female arm;

the female arm having a slot extending through the female arm and in which the male arm is rotatably and longitudinally movably mounted;

the male arm having an almond-shaped window with teeth on an internal edge of the window, the almond-shaped window extending transverse to the slot, the female arm having a first coaxial opening and a second coaxial opening, the first coaxial opening and the second coaxial opening being coaxial to each other, lying in planes parallel to a plane of the almond-shaped window and extending transverse to the slot, the first coaxial opening facing one side of the male arm and the second coaxial opening facing another side of the male arm;

a pawl positioned in the almond-shaped window and longitudinally and transversely movable in the almond-shaped window, the pawl having teeth that mate with the teeth of the almond-shaped window;

a protuberance extending transversely from one side of the female arm, the protuberance encircling the second coaxial opening and defining a box-shaped opening which is open at one side to the one side of the female arm and open at the other side to the second coaxial opening;

the box-shaped opening being wider than the second coaxial opening so as to provide a ledge between the other side of the box-shaped opening and the second coaxial opening;

a seat provided in the first coaxial opening and facing the other side of the female arm, the one side of the female arm opposite the other side of the female arm;

a hinge pin having a headpiece at one end with a surrounding ledge seated in the seat of the first coaxial opening and a threaded area at the other end, the surrounding ledge of the hinge pin resting on the seat of the first coaxial opening allowing the headpiece of the hinge pin to sit flush within the other side of the female arm;

a pusher having a headpiece, an extension that is narrower than the headpiece, an inner box-shaped opening between an inner sidewall of the headpiece and the extension, a spring located in the inner box-shaped opening and abutting the ledge, and the headpiece of the pusher is always situated within the box-shaped opening of the protuberance, continuously protecting the spring;

the pusher screwed to the threaded area of the hinge pin with the almond-shaped window, the first coaxial opening, second coaxial opening, the pawl and the protuberance positioned coaxially between the hinge pin and the pusher; and the extension of the pusher being in mechanical engagement with the pawl and hinge pin.

2. The pliers, according to claim 1, wherein a diameter of the first coaxial opening is greater than a diameter of the second coaxial opening.

3. The pliers, according to claim 1, wherein the pawl and the extension of the pusher are made of wear-resistant material.

* * * * *